United States Patent [19]

Rice et al.

[11] Patent Number: 4,607,611

[45] Date of Patent: Aug. 26, 1986

[54] SOLID FUEL HEATING DEVICE

[75] Inventors: James S. Rice, Marshall; Barry Eavenson; Garry Eavenson, both of Asheville; Thomas A. Bryson, Horseshoe, all of N.C.

[73] Assignee: Appalachian Stove and Fabricators, Inc., Asheville, N.C.

[21] Appl. No.: 639,236

[22] Filed: Aug. 9, 1984

[51] Int. Cl.[4] ..... F24B 7/00

[52] U.S. Cl. ..... 126/121; 126/126

[58] Field of Search ..... 126/63, 120, 121, 123, 126/126

[56] References Cited

U.S. PATENT DOCUMENTS

| | | | |
|---|---|---|---|
| 4,095,581 | 6/1978 | Billmeyer et al. | 126/121 |
| 4,177,793 | 12/1979 | Johnson | 126/121 |
| 4,271,815 | 6/1981 | Johnson | 126/121 |
| 4,287,871 | 9/1981 | Schumann et al. | 126/121 X |
| 4,304,215 | 12/1981 | Jarman | 126/121 |
| 4,369,761 | 1/1983 | Burnette | 126/123 X |

*Primary Examiner*—Margaret A. Focarino

*Attorney, Agent, or Firm*—David M. Carter

[57] ABSTRACT

There is provided an improved heating device which utilizes a standard forced air solid fuel burning stove enclosd in a metal box and surrounded by a layer of thermal insulation. A metal shield surrounds at least the upper portion of the stove with air spaces provided between the stove and the shield as well as between the shield and the insulation on the walls of the box. The outer surfaces of the walls of the heating device are adapted to come into direct contact with combustible building materials, thus solving the clearance problem associated with most solid fuel burning stoves.

28 Claims, 6 Drawing Figures

SOLID FUEL HEATING DEVICE

BACKGROUND OF THE INVENTION

This invention relates to solid fuel heating devices. More particularly, it relates to a heating device having outer surfaces which may come into direct contact with combustible building materials. As a result of the recent energy crisis, and particularly because of a shortage of fossil fuels for heating purposes, solid fuel burning stoves have been developed. These stoves are normally adapted to burn either wood or coal. Some of the more popular stoves are made with a double-wall construction, and are used in association with a blower to provide a forced air system.

One of the problems associated with heating with a stove is the fact that its outer surfaces tend to get rather hot, even with a double-wall construction. Therefore, state and local regulatory bodies, as well as quasi-regulatory bodies, such as Underwriters Laboratories, have required a certain air clearance or other non-combustible clearance between the outer surface of the stove and normal combustible materials, such as wood, carpeting, etc. When the stove is used in its free-standing mode, some codes require a two-foot clearance between the outer surfaces of the stove and combustible building materials.

Some users of wood stoves have solved this problem by placing the stove in a fireplace. These types of stoves are often called fireplace inserts. One of the problems in utilizing a fireplace insert is the inability to get a tight enough seal around the opening of the fireplace; therefore, warm air from the room will go up the chimney. An even bigger problem, of course, is that many houses simply do not have fireplaces. Thus, in order for one to use a wood stove in a house which does not have a fireplace, one would normally have to install his stove somewhat towards the middle of a room, which quite often is not an acceptable practice, both from a utilitarian standpoint as well as from an aesthetic standpoint. Also, with the outer surface of the stove being hot, there is a danger of small children coming into contact with the stove. Therefore, there is a need to provide a solid fuel heating device which solves the above problems.

OBJECTS OF THE INVENTION

It is, therefore, one object of this invention to provide an improved solid fuel heating device.

It is another object to provide a solid fuel heating device which has substantially zero clearance between its outer surface and combustible building materials.

It is still another object to provide a solid fuel heating device which may be used in a similar fashion as fireplace inserts without the requirement of an actual fireplace.

It is still another object to provide a solid fuel heating device which may readily be used by building contractors during housing construction.

SUMMARY OF THE INVENTION

In accordance with one form of this invention, there is provided a heating device, including a forced air stove which is adapted to burn solid fuel, such as wood or coal. A metal box defining a partial parallelepiped shaped enclosure is also provided. The front of said box is open for receiving the stove, with the front of the stove substantially filling the front open space of the box. The top of the box has a hole therein for venting smoke and gases from the stove. A layer of thermal insulation is provided adjacent to substantially the entire inside surface of the box. The stove is positioned within the box so as to leave an air space at least between the thermal insulation on the respective side, top and rear walls of the box and the outer side, top and rear walls of the stove.

Another form of the invention includes the above described metal box per se.

BRIEF DESCRIPTION OF THE DRAWINGS

The subject matter which is regarded as the invention is set forth in the appended claims. The invention itself, however, together with further objects and advantages thereof, may be better understood by reference to the following description, taken in conjunction with the accompanying drawings, in which:

DESCRIPTION OF THE PREFERRED EMBODIMENT

Figure 1:
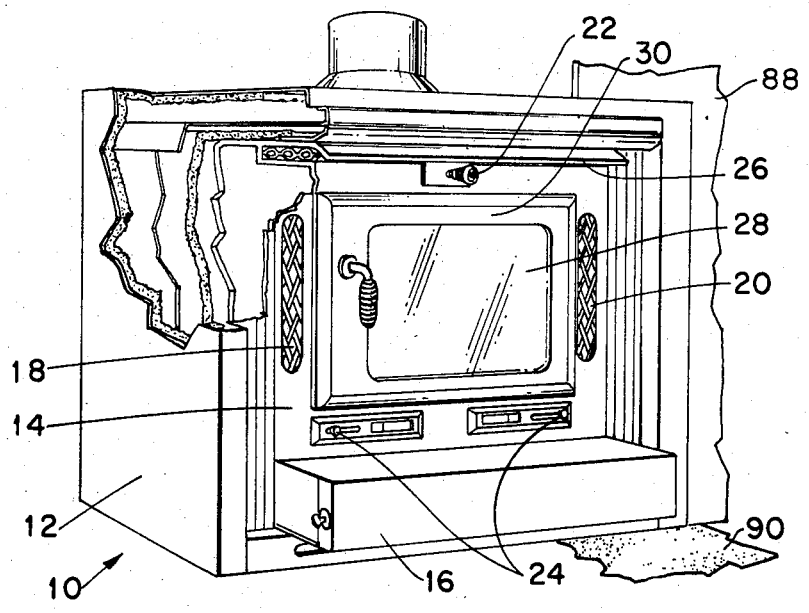
FIG. 1 is a pictorial view of the improved heating device of the subject invention with portions of the walls removed.

Referring now more particularly to FIG. 1, there is provided improved solid fuel heating device 10, including metal box 12 and forced air stove 14. Many different types of forced air stoves are applicable to this invention; however, the preferred stove and the one shown in FIG. 1 is the Trailmaster 4N1 TM, manufactured by Appalachian Stove and Fabricators of Asheville, N.C. The wood stove 14 is of a double wall construction, so that air coming from fans which are in housing 16 comes into contact with the hot surfaces of the stove and out of openings 18 and 20 and into the room.

A sliding damper 22 and sliding regulators 24 are provided for regulating the burn rate in the stove. Deflector 26 is provided to deflect heat down. High temperature glass 28 is secured to entry door 30 of the stove so that the fire may be viewed.

Figure 2:
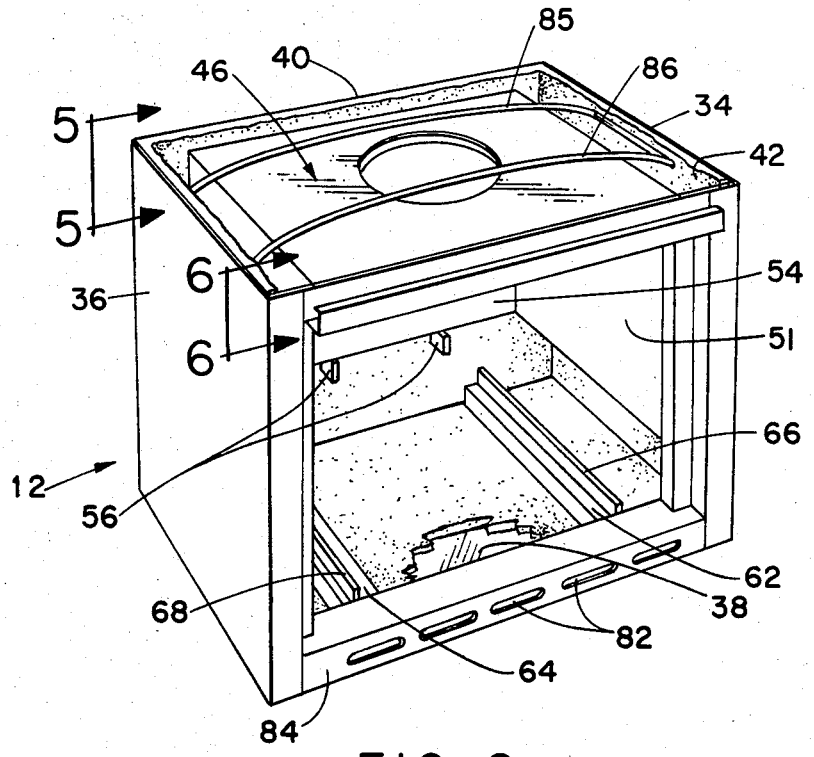
FIG. 2 is a pictorial view of the metal box forming the enclosure for a heating device which incorporates several of the features of this invention.
Figure 4:
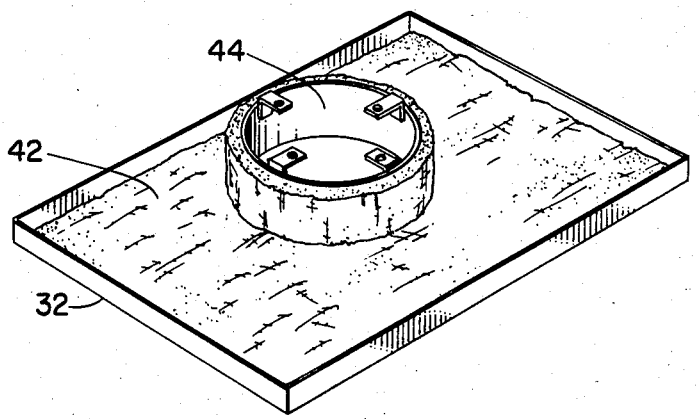
FIG. 4 is a pictorial view of the top for the metal box shown in FIG. 2, and is shown upside down for ease of understanding.

Referring now to FIG. 2, there is shown metal box 12 without its top 32, which is shown in FIG. 4, thereon, and further without the stove being mounted inside the box. Box 12 includes a pair of side walls 34 and 36 made of sheet metal, a sheet metal bottom 38, a rear wall 40, and, of course, top 32, which is referred to in FIG. 4. A thermal insulation material 42 is attached to all of the inner surfaces of side and rear walls of the metal box 12, as well as the floor 38 and the top 32. This thermal insulation also surrounds the outer surface of flue 44, which is shown in FIG. 4. This thermal insulation material is preferably a ceramic fiber; however, other non-combustible insulation materials may be used. The box further includes metal shield 46 which completely surrounds the upper portion of the stove. Shield 46 includes top 48 having hole 50 therethrough for receiving smoke and gases from the burning of the solid fuel in the stove. The shield also includes side walls 51 and 52 and rear wall 54.

In the embodiment of FIG. 2, the side and rear walls of shield 46 only extend partway down from its top inside of box 12. In view of the fact that most of the heat is toward the top part of the box, it is believed that the shield need not extend all the way into the bottom floor of the box. Studs 56, which are attached to the rear wall of the box, help maintain the shield in its position.

Figure 3:
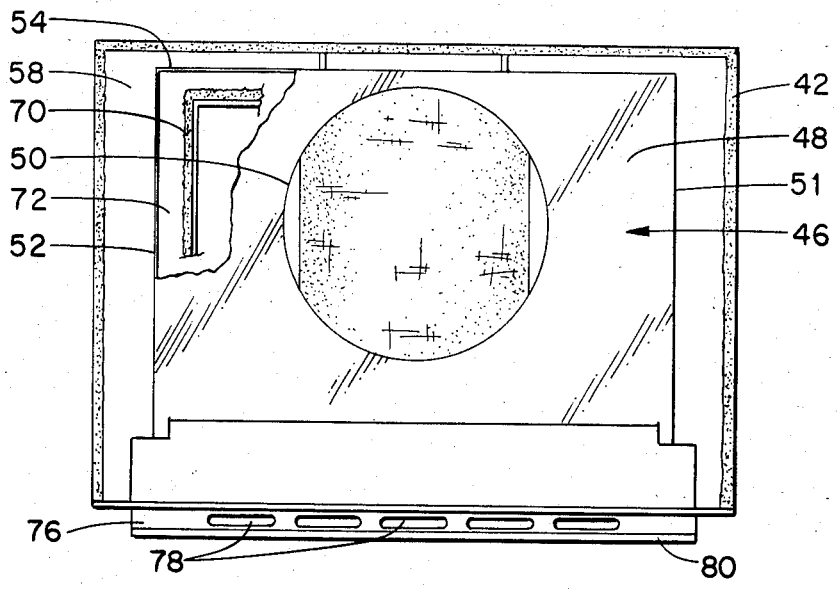
FIG. 3 is a top view of the metal box shown in FIG. 2 with a portion of the top cut away and showing a portion of the stove which is adapted to be received therein.
Figure 5:
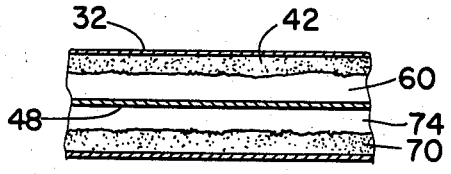
FIG. 5 is a cutaway portion of FIG. 2, taken along section lines 5—5.

As seen in FIG. 3, shield 46 is set in away from thermal insulation 42, thus forming an air chamber 58 between the outside surfaces of the shield and the thermal insulation 42. Also, as can be seen from FIG. 5, an air space 60 is formed between the top 48 of the shield and insulation 42 which is on the inside surface of top 32 of the metal box.

Referring again to FIG. 2, a pair of beams 62 and 64 run from the front opening of box 12 to rear wall 40. Furthermore, a pair of lips 66 and 68 project upwardly from the outer periphery of the beams. The bottom of the stove rests on the top surfaces of beams 62 and 64, which elevates the stove from the floor of the box, thus providing an air space between a substantial portion of the bottom of the stove and the insulated bottom of the box. Lips 66 and 68 help guide the stove into the box during construction of the heating device. The lips 66 and 68 also insure that the stove is somewhat centered within the enclosure formed by the metal box. As can be seen from FIG. 3, the outer surfaces of at least the top and sides of the stove walls are blanketed with additional thermal insulation 70, which may be the same type of thermal insulation 42. An air space 72 is also provided between the inside surface of the side and rear walls of the shield, and the thermal insulation 70. Furthermore, as can be seen from FIG. 5, an air space 74 is also provided between the top 48 of shield 46 and thermal insulation 70, which is on the top of the stove.

Figure 6:
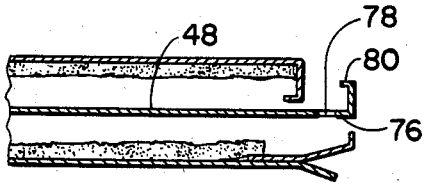
FIG. 6 is a cutaway portion of FIG. 2, taken along section lines 6—6.

As can be seen from FIG. 3, top portion 48 of shield 46 extends outside of the metal box enclosure forming heat dissipation surfaces 76. A plurality of holes 78 are provided in these heat dissipation surfaces to enhance the dissipation of the heat from the top of the shield. This may be seen better in reference to FIG. 6. Furthermore, the end of the shield 80 is bent at an L-shape to prevent the exposure of a sharpened end of metal, and further to provide additional surface area for heat dissipation.

Referring again to FIG. 2, a plurality of holes 82 are provided in the small facing 84, which is provided in the lower portion of the opening in the box to permit heat to escape from the inside of the box. In order to insure that the insulation material 42, which is on the top of the box shown in FIG. 4, does not fall, a pair of bowed rods 85 and 86, with their ends pressed against the insulation on the side walls of the box, are provided. Thus, when top 32 is placed onto the box 12, the rods will press against insulation 42 and hold the insulation in place.

The above described heating device has been found to exhibit such low temperatures on the outer surfaces of box 12 so that the heating device may be installed directly against common combustible construction materials without the need to provide for clearances, or airspaces. Combustible building materials such as wall 88 and carpet 90 are in direct contrast with the outer surfaces of the heating device, as shown in FIG. 1. Thus, a zero clearance heating device which may be utilized in a broad number of both new and existing houses without the need to have a pre-existing fireplace and, further, without the need to provide clearances between the device and combustible materials is provided.

From the foregoing description of the preferred embodiment of the invention, it will be apparent that many modifications may be made therein without departing from the true spirit and scope of the invention.

I claim:

1. A heating device comprising:

a forced air stove adapted to burn solid fuel; said stove being at least partially made of a double-wall construction forming an air space so that air may be forced along the hot portions of said stove;

a metal box defining a partial parallelepiped shaped enclosure, the front of said box being open for receiving said stove, with the front of said stove substantially filling the front open space of said box; the top of said box having a hole therein for venting smoke and gases from said stove;

a layer of thermal insulation attached to and covering substantially the entire inside surface of said box;

said stove being removably positioned within said box so as to leave a second air space at least between the thermal insulation on the respective side, top and rear walls of said box, and the outer side, top and rear walls of the stove, there being no substantial heat conducting connecting elements between said insulation and said walls of the stove.

2. A device as set forth in claim 1, further including means for elevating said stove from the floor of said box.

3. A device as set forth in claim 2, wherein said means for elevating is a pair of elongated beams having a pair of lips running along the outer periphery thereof for guiding the stove into the box and holding the stove in a somewhat central position within the box.

4. A device as set forth in claim 1, further including a metal shield received within said box and positioned between portions of said stove and portions of said metal box.

5. A device as set forth in claim 4, wherein said metal shield being in the shape of a partial parallelepiped and having a top with a hole therethrough for aligning with said hole in the top of said metal box, said shield further having a pair of side walls and a rear wall.

6. A device as set forth in claim 5, wherein said side walls and rear walls of said shield are connected to said top wall of said shield, said side and rear walls not extending all the way to the bottom of said metal box.

7. A device as set forth in claim 5, further including means for retaining said shield to said box.

8. A device as set forth in claim 5, further including a third air space between said stove and said metal shield.

9. A device as set forth in claim 8, further including another layer of thermal insulation positioned between said stove and said shield.

10. A device as set forth in claim 1, further including means for securing insulation to the inside surface of the top of said box.

11. A device as set forth in claim 1, wherein the outer surface of said metal box is adapted to contact combustible materials with the outer surface of said box being sufficiently cool while there is a fire in the stove so as not to ignite the combustible materials.

12. A device as set forth in claim 1, further including a small facing on the extreme lower portion of the front opening of said box, a plurality of holes received in said facing for passing hot air from the inside of said box to the outside of said box.

13. A device as set forth in claim 5, further including a metal plate attached to said shield and being partially outside of said box and partially extending into the extreme upper portion of the front opening of said box, a plurality of holes in the portion of said metal plate which is outside of said box for dissipating heat from the upper portion of said box.

14. An insulated enclosure comprising:

a metal box defining a partial parallelepiped shaped enclosure; said box adapted to receive a forced air stove which burns solid fuel; the front of said box being open for receiving the stove, with the front of the stove substantially filling the front open space of said box; the top of said box having a hole therein for venting smoke and gases from the stove;

a layer of thermal insulation attached to and covering substantially the entire inside surface of said box;

the stove adapted to be removably positioned within said box so as to leave a complete, object-free second air space at least between the thermal insulation on the respective side, and rear walls of said box, and the outer side, and rear walls of the stove, there being no substantial heat conducting connecting elements between said insulation and the outer side and rear walls of the stove.

15. A device as set forth in claim 14, further including means for elevating the stove from the floor of said box.

16. A device as set forth in claim 15, wherein said means for elevating is a pair of elongated beams having a pair of lips running along the outer periphery thereof for guiding the stove into the box and holding the stove in a somewhat central position within the box.

17. A device as set forth in claim 14, further including a metal shield received within said box and positioned between portions of said stove and portions of said metal box.

18. A device as set forth in claim 17, wherein said metal shield being in the shape of a partial parallelepiped and having a top with a hold therethrough for aligning with said hole in the top of said metal box, said shield further having a pair of side walls and a rear wall.

19. A device as set forth in claim 18, wherein said side walls and rear walls of said shield are connected to said top wall of said shield, said side and rear walls not extending all the way to the bottom of said metal box.

20. A device as set forth in claim 18, further including means for retaining said shield to said box.

21. A device as set forth in claim 18, further including an air space between the stove and said metal shield.

22. A device as set forth in claim 21, further including another layer of thermal insulation positioned between the stove and said shield.

23. A device as set forth in claim 14, further including means for securing insulation to the inside surface of the top of said box.

24. A device as set forth in claim 23, wherein said means for securing includes a pair of bowed rods having ends contacting the thermal insulation of the sides of said box, portions of said rods contacting portions of said thermal insulation on the inside surface of the top of said box.

25. A device as set forth in claim 14, wherein the outer surface of said metal box is adapted to contact combustible materials with the outer surface of said box being sufficiently cool while there is a fire in the stove so as not to ignite the combustible materials.

26. A device as set forth in claim 14, further including a small facing on the extreme lower portion of the front opening of said box, a plurality of holes received in said facing for passing hot air from the inside of said box to the outside of said box.

27. A device as set forth in claim 18, further including a metal plate attached to and being partially outside of said box and partially extending into the extreme upper portion of the front opening of said box, a plurality of holes in the portion of said metal plate which is outside of said box for dissipating heat from the upper portion of said box.

28. A heating device comprising:

a forced air stove adapted to burn solid fuel;

a metal box defining a partial parallelpiped shaped enclosure, the front of said box being open for receiving said stove, with the front of said stove substantially filling the open space of said box, the top of said box having a hole therein for venting smoke and gases from said stove;

a layer of thermal insulation adjacent substantially the entire inside surface of said box;

said stove being positioned within said box so as to leave an air space at least between the thermal insulation on the respective side, top and rear walls of said box, and the outer side, top and rear walls of said stove;

means for securing insulation to the inside surface of the top of said box, said means for securing including a pair of bowed rods having ends contacting the thermal insulation of the sides of said box, portions of said rods contacting portions of said thermal insulation on the inside surface of the top of said box.

* * * * *